US006868805B2

(12) United States Patent
Tranquilli

(10) Patent No.: US 6,868,805 B2
(45) Date of Patent: Mar. 22, 2005

(54) HORIZONTALLY ORIENTED COMBUSTION APPARATUS

(75) Inventor: Nicholas A. Tranquilli, Buffalo, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/385,979

(22) Filed: Mar. 10, 2003

(65) Prior Publication Data

US 2003/0219689 A1 Nov. 27, 2003

Related U.S. Application Data

(63) Continuation of application No. 10/152,226, filed on May 21, 2002, now Pat. No. 6,572,367.

(51) Int. Cl.[7] ..... F24H 1/20

(52) U.S. Cl. ..... 122/44.1; 122/50; 122/18.31; 122/106

(58) Field of Search ..... 122/44.1, 49, 123, 122/50, 51, 68, 79, 106, 114, 116, 119; 431/2, 9, 12, 343, 353

(56) References Cited

U.S. PATENT DOCUMENTS

| | | | | |
|---|---|---|---|---|
| 2,344,439 A | | 3/1944 | Lloyd | |
| 3,903,868 A | * | 9/1975 | Salvo | 122/18.31 |
| 4,170,963 A | * | 10/1979 | Siegrist | 122/33 |
| 4,397,296 A | * | 8/1983 | Moore et al. | 122/14.22 |
| 4,519,770 A | * | 5/1985 | Kesselring et al. | 431/7 |
| 4,660,541 A | * | 4/1987 | Moore | 122/18.31 |
| 5,399,085 A | | 3/1995 | Taylor | |
| 5,511,516 A | * | 4/1996 | Moore et al. | 122/18.31 |
| 5,520,537 A | | 5/1996 | Taylor | |
| 5,616,021 A | * | 4/1997 | Onimaru et al. | 431/115 |
| 5,666,944 A | * | 9/1997 | Ferguson | 122/18.3 |
| 6,089,223 A | * | 7/2000 | Jasper et al. | 126/359.1 |
| 6,223,698 B1 | * | 5/2001 | Lacaze | 122/31.2 |
| 6,231,334 B1 | | 5/2001 | Bussman et al. | |

* cited by examiner

*Primary Examiner*—Gregory Wilson
(74) *Attorney, Agent, or Firm*—Ware Fressola Van Der Sluys & Adolphson, LLP

(57) ABSTRACT

A combustion chamber for a chiller includes a burner and igniter which are maintained in the horizontal position. The horizontal positioning is implemented by a steel casting, which includes a thick flange portion. The thick flange portion is between the combustion chamber and the outside surface, therefore keeping the outside surface cooler. The steel casting has a mitered extension of the combustion chamber, which allows for more efficient heat transfer. By orienting the burner and igniter in the steel casting in the horizontal position, one eliminates prior art ceramic annular cooling devices. The horizontal orientation enables the overall height of the generator to be decreased and also allows for easy access during installation and maintenance of the burner and igniter.

43 Claims, 5 Drawing Sheets

HORIZONTALLY ORIENTED COMBUSTION APPARATUS

CROSS-REFERENCE TO RELATED APPLICATIONS

This application is a continuation of U.S. patent application Ser. No. 10/152,226, filed May 21, 2002, now U.S. Pat. No. 6,572,367 which is hereby incorporated by reference.

BACKGROUND OF THE INVENTION

1. Field of Invention

This invention relates to a combustion chamber apparatus and more particularly, to a burner and igniter of a combustion chamber having a horizontal orientation for use in an aqua-ammonia absorption chiller.

2. Description of Related Art

A combustion chamber basically operates to accommodate detonation of a fuel which may be a gas to achieve optimum operation. While there are many uses for combustion chambers, a particular application employs a combustion chamber in an aqua-ammonia absorption chiller. Such chillers operate to heat a solution of water and ammonia used as a refrigerant to convert the solution to a gas which cools as it condenses. In such chillers, a combustion chamber which includes a burner and an igniter is used to heat the solution and to convert it to a gas.

In any event, the prior art combustion chambers for such chillers are oriented in the vertical position and because of such orientation, they are difficult to maintain. Utilizing a vertical orientation for the burner and igniter in such a combustion chamber resulted in various difficulties in the prior art. One difficulty was the vertical configuration required a larger vertical profile, which therefore made the unit difficult to repair and maintain, as well as difficult to install. Because of the orientation, the installation and maintenance of various portions of the vertical burner and igniter caused breakage during installation, as well as various other problems. The prior art unit was difficult to repair and maintain.

In any event, it is an object of the present invention to provide an improved burner ignition configuration to be employed in a chiller combustion chamber in which the configuration is arranged in a horizontal orientation.

SUMMARY OF INVENTION

A horizontal combustion chamber uses a mitered extension of a combustion chamber casting. The casting has a flange portion which eliminates the need for a ceramic cooling ring. The flange portion on the casting is of an increased thickness and therefore, provides more thermal isolation between the inner combustion chamber and the outside surface of the housing. By utilizing a horizontal orientation, the clearance between the outer diameter of the burner and the flange is decreased. This creates a volume for cooling to occur, while the increased wall thickness of the chamber allows for a heat sink effect. The use of the horizontal orientation allowed the overall height of the generator to be decreased and also enabled full access during installation and maintenance of the burner and igniter, resulting in a significant savings of maintenance time.

DETAILED DESCRIPTION OF THE INVENTION

Figure 1:
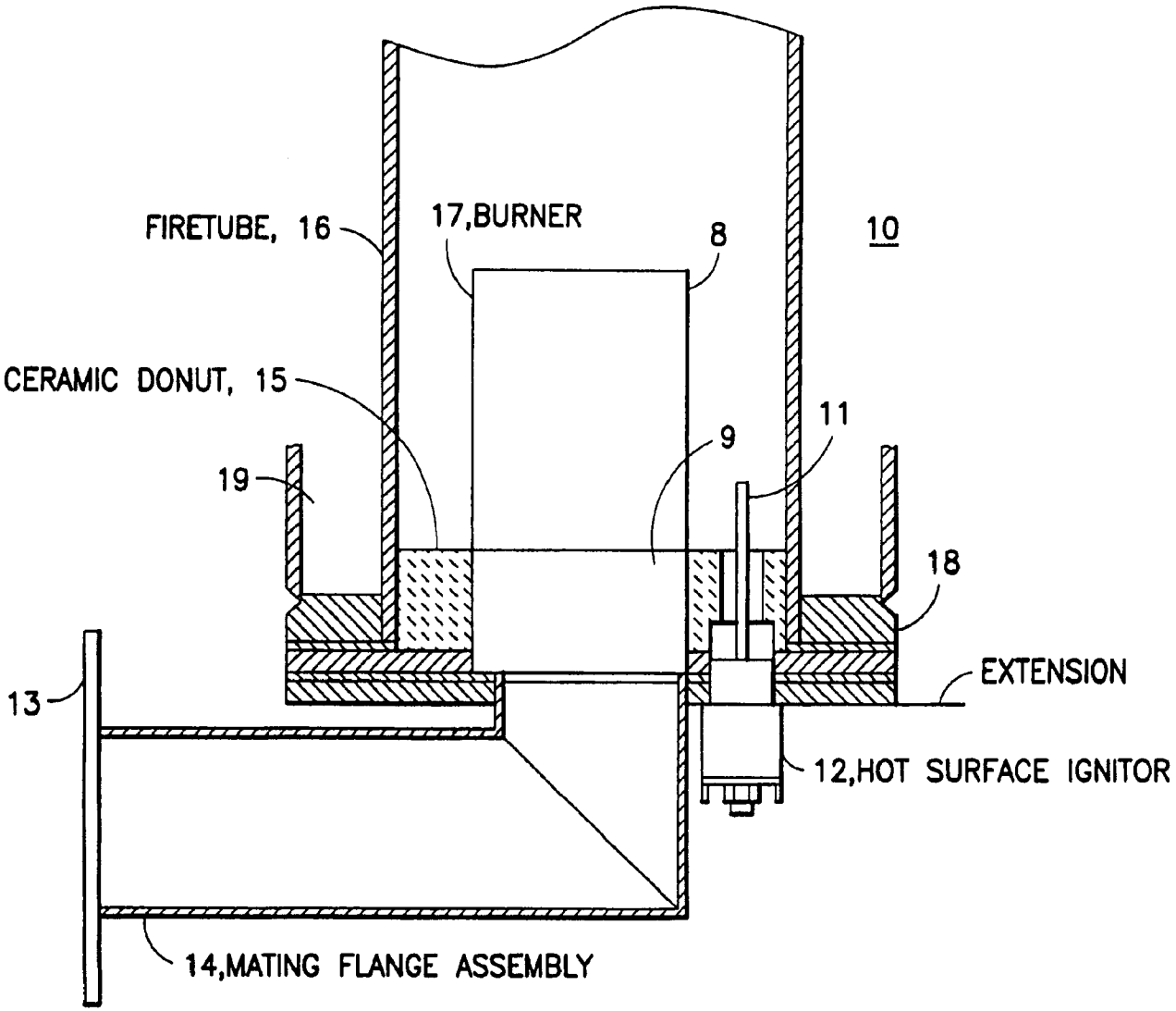
FIG.1 PRIOR ART
FIG. 1 is a cross sectional view of the prior art combustion chamber burner ignition system.

Referring to FIG. 1 there is shown a prior art vertical burner and igniter 10 positioned in a combustion chamber of a gas fire generator. As one can see, the burner 17 has a top portion 8 which is basically of a mesh-like or perforated configuration and has a bottom portion, which is non-perforated. The burner, as utilized in conjunction with combustion chambers, allows a gas to flow therethrough which gas is ignited by means of a hot surface igniter 12 having a graphite rod 11, which basically forms the hot surface for ignition. Gas is introduced into the chamber by the mating flange 14 which is a tube and is connected to a blower (not shown) at flange 13. The blower introduces the gas into the burner 17, which gas is ignited by the hot surface igniter 12. As can be seen, the bottom metal portion 9 of the burner 17 is surrounded by a ceramic donut or annular ceramic ring 15. This donut section is extremely fragile and difficult to work with. It is also noted that after firing, the ceramic material can become carcinogenic and therefore, may present problems to maintenance workers who work with and otherwise maintain the burner.

The configuration of FIG. 1 is in the vertical orientation and is mounted on the mating flange assembly 14, which is associated with the gas-fired generator. In such vertical orientations, the difficulty is with the mounting of the flange portion under the generator, as well as additional parts needed for mating the flange assembly to the burner 17 and igniter 12. As one can see, the additional parts are referenced by numeral 18 and consist of retaining rings and additional insulating devices which mount to the mating flange assembly 14. As one can also see by the arrows marked "extension", there was an additional extension required under the generator to allow for installation and maintenance of the burner and for the mating flange assembly. This essentially increases-the overall height of the generator by many inches. This becomes a problem in regard to increasing the overall height of the final chiller assembly.

As seen, the burner 17 is surrounded by an inner vertical tube or fire tube 16. Fire tube 16 is surrounded by an outer tube or outer shell 19 (partially shown). The outer tube 19 accommodates the aqua-ammonia solution which is headed by the burner 17, transferring heat through the fire tube 16. The fire tube 16 has to be supported by the additional ancillary parts 18, including extending flanges and so on. In order to gain access to the burner 17 and the igniter 12, a great deal of maintenance time was involved in removing the coupling structures to gain access to the burner and igniter 12. It is noted that the fire tube 16 and the outer tube or fluid containing shell 18 are vertically oriented. The hot surface igniter 12 is also vertical and during installation or maintenance, the graphite tip 11 would often be broken, resulting in additional expense and time.

Figure 2A:
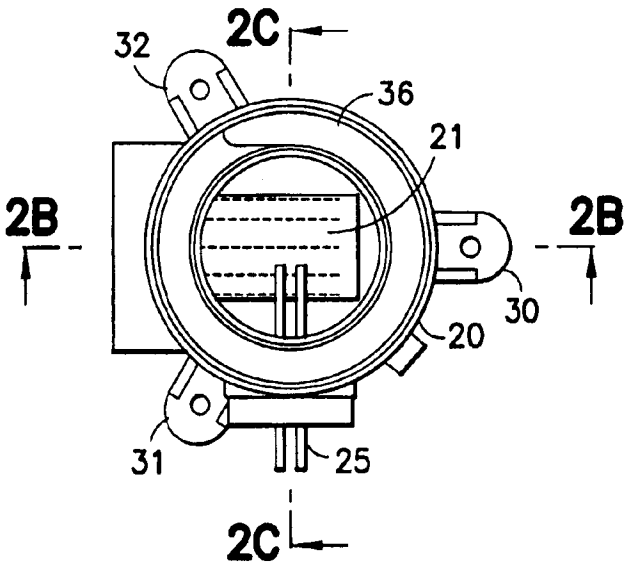
FIG. 2A is a front view of a combustion chamber according to this invention.
Figure 2C:
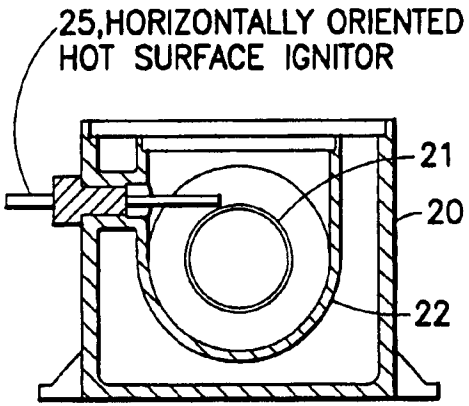
FIG. 2C is a cross sectional view taken through a section line CC of FIG. 2.
Figure 2B:
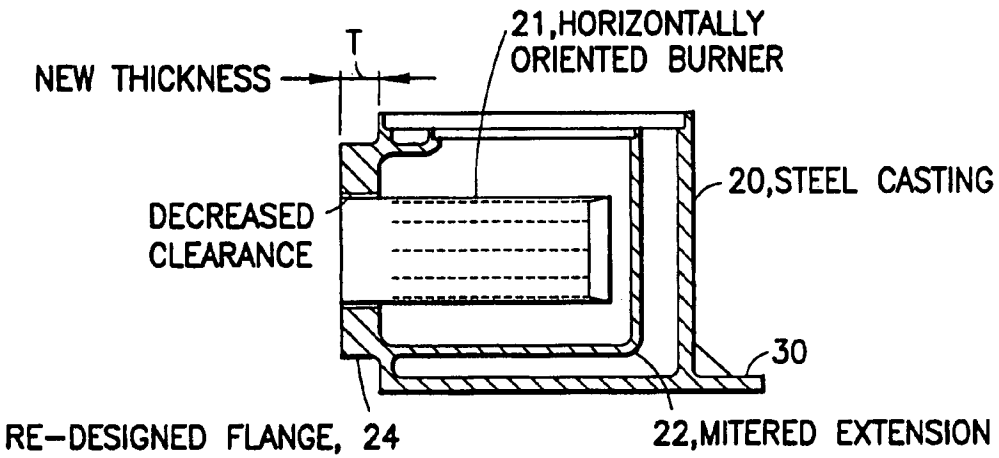
FIG. 2B is a cross sectional view taken through a section line BB of FIG. 2.

FIG. 2A shows a front view of a combustion chamber consisting of a burner 21 and igniter 25 in a horizontal orientation. FIG. 2B is a section through line BB of FIG. 2A, while FIG. 2C is a section through line CC of FIG. 2A. As will be explained, the burner 21 and igniter 25 are held in a horizontal position by creating a mitered extension 22 of the combustion chamber in a steel casting 20. The casting 20 also has a flange portion 24 which has been designed to eliminate the need for the ceramic donut 15 as shown in FIG. 1. The design of the flange portion 24 of the casting 20 increases the thickness of the material between the inside of the combustion chamber and the outside surface. This is shown in FIG. 2B by the designation T. The casting 20 decreases the clearance between the outer diameter of the non-perforated section of the burner 21 and the flange 24. This creates a volume for cooling to occur while the increased wall thickness allows for a heat-sink effect. The horizontal orientation allows the elimination of the mating flange assembly (14 of FIG. 1), as well as the ceramic donut (15 of FIG. 1) which, as indicated, is needed for high temperature. The improved configuration also allowed the overall height of the generator to be decreased by eliminating the need for the extended height as shown in FIG. 1 depicted by the arrows marked "extension". The casting 20 enables full access during installation and maintenance of the burner 21 and igniter 25 and therefore eliminates the problems with parts breaking as, for example, the graphite rod 11.

Again, referring to FIG. 2A there is shown the steel casting 20 which has positioned therein the burner 21. Burner 21 is the same as burner 17 of FIG. 1. Burner 21, as indicated in FIG. 2B, is essentially maintained in a front portion of the casting 20, which has the thick integral flange 24. The burner 21 is held in position by means of an end flange located on the non-perforated bottom portion of the burner. As indicated and shown in FIG. 2A, the steel casting 20 has mounting tabs 30, 31 and 32, which are integrally formed in the casting. Also shown in FIG. 2B is that the burner 21, which is horizontally oriented, is now surrounded by the mitered section 22. The mitered extension 22 basically surrounds the burner 21. As one can see, there is a front opening 36. This front opening 36 enables one to accommodate the fire tube and the outer shell.

As one can see, the igniter 25 is in a horizontal position and is now transverse to the central axis of the burner 21 instead of being parallel to the central axis of the burner 17 (FIG. 1). This allows for improved operation and maintenance.

Figure 3:
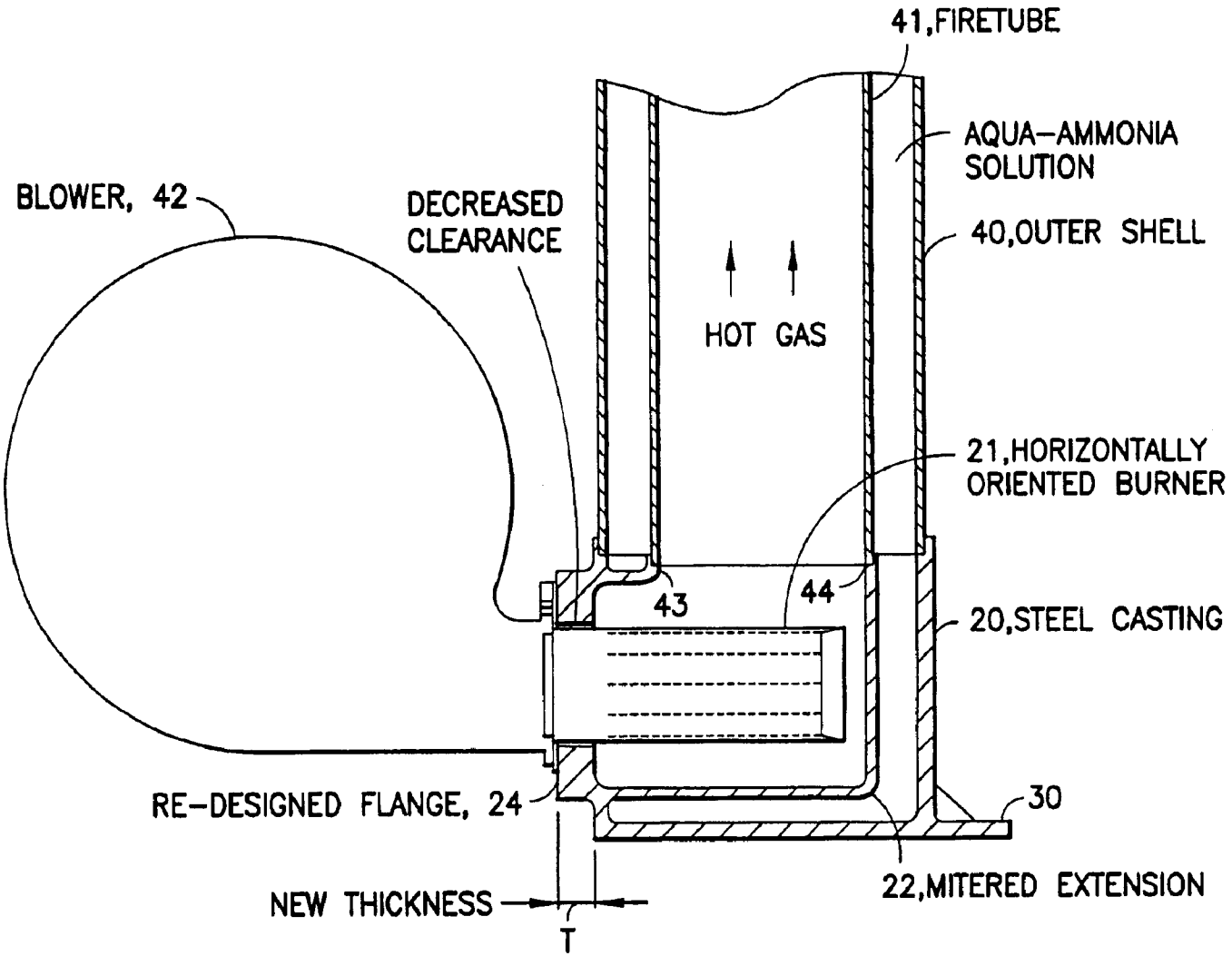
FIG. 3 is cross sectional view as in FIG. 2B, depicting the casting coupled to a fire tube and outer shell on a blower.

Referring to FIG. 3 there is shown a similar section as of FIG. 2B depicting the combustion chamber and to show how it is utilized in the chiller. As seen in FIG. 3 the steel casting 20, which includes the mitered extension 22, enables an outer shell 40 to be accommodated between the outer wall of the steel casting 20 and the mitered section 22. Thus, the outer shell 40 is inserted within the front aperture of the housing and is held in position, as depicted in FIG. 3. In a similar manner, the fire tube 41 is inserted in the front aperture and is supported by the mitered section of the housing indicated by numerals 43 and 44 at the support points. As one can also see, a blower 42 is secured to the thick flange 24, where it is bolted to the flange. In a similar manner, the burner 21 can also be bolted to the thick flange 24 by means of a conventional coupling. The blower 42, as indicated, circulates ignitable gas which may be ordinary gas or propane to the burner 21, the burner 21 in turn is heated by the gas, as shown in FIG. 3 by the arrows, where hot gas flows through the fire tube 41 to heat the aqua-ammonia solution, which circulates between the fire tube outer wall 41 and the outer shell 40. One can actually compare FIG. 3 to FIG. 1 to show how the similar components are accommodated, such as the outer shell 40 and fire tube 41, as well as the blower assembly and the remaining modules. It is also seen from FIG. 3, as will be further explained, that the casting for the combustion chamber and burner accommodating assembly is compact and easy to access.

Figure 4:
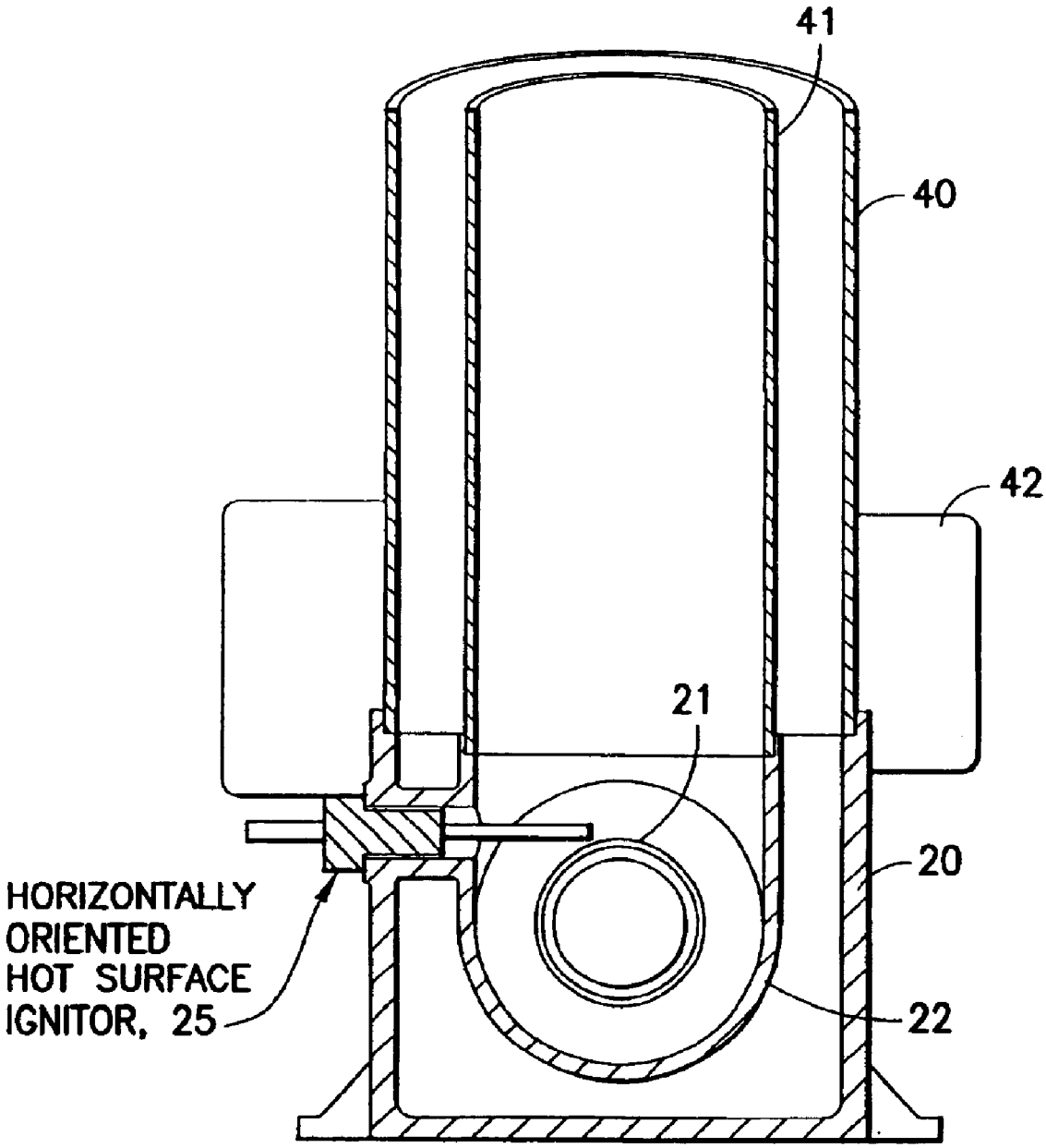
FIG. 4 is a view as in FIG. 2C, depicting the various components coupled to the casting.

FIG. 4 shows the steel casting 20 in the orientation as depicted in FIG. 2C, accommodating the outer shell 40 and the fire tube 41. Also seen in FIG. 4 is the horizontally oriented hot surface igniter 25, as positioned with respect to the horizontally oriented burner 21.

Figure 5:
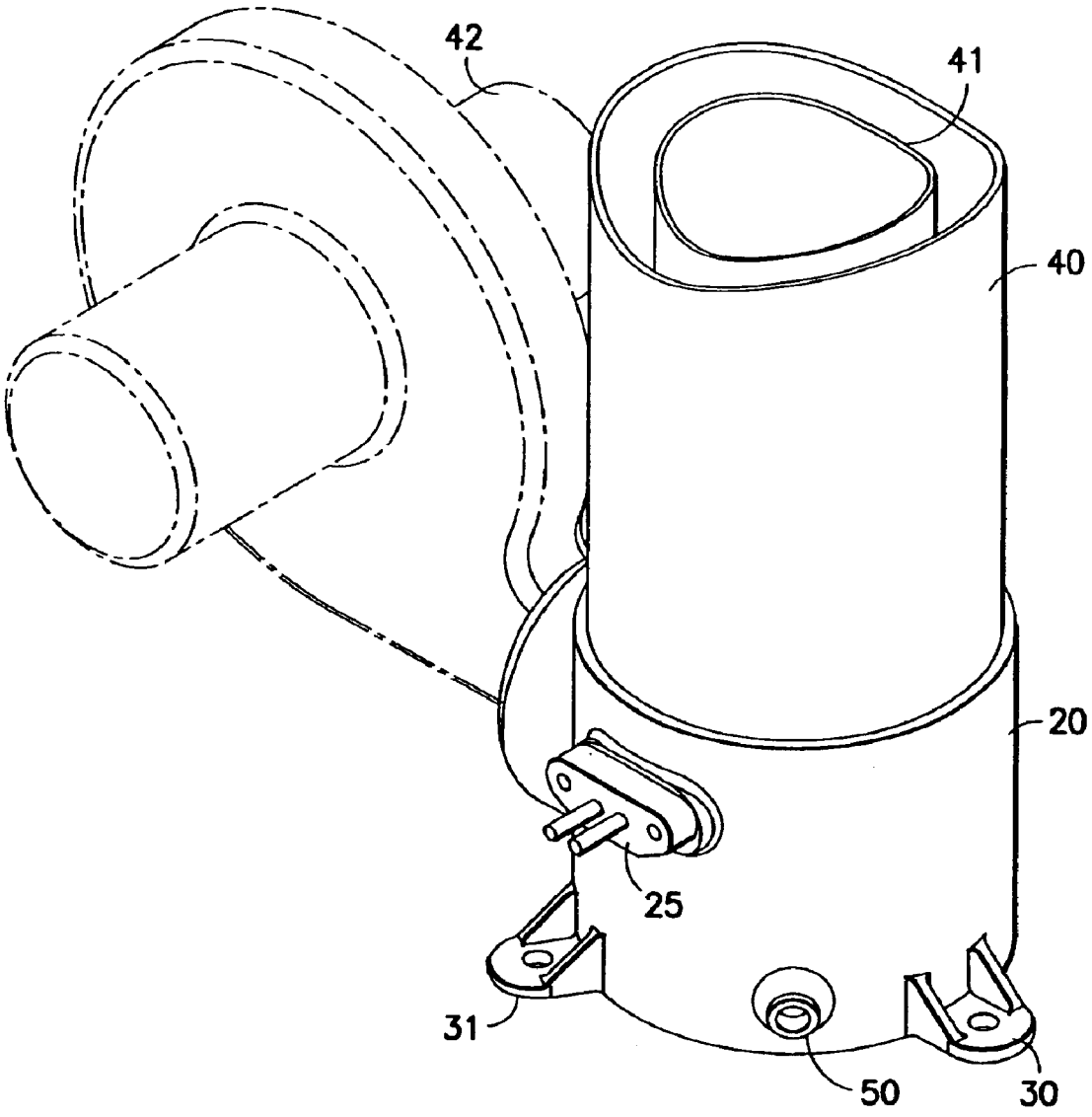
FIG. 5 is a perspective view of the casting assembly accommodating the various components associated with the chiller according to this invention.

Referring to FIG. 5, there is shown a perspective view of the steel casting 20 accommodating the fire tube 41 and the outer shell 40 and can also see the output electrodes of the hot surface igniter 25 and the blower 42 coupled to the blower input port of the assembly. As seen in FIG. 5, it is a very compact assembly whereby the tabs 30 and 31 can be mounted to the corresponding surface of the chiller and the entire unit as shown in FIG. 5, with the exception of the blower, can be assembled onto the chiller. As can be seen clearly in FIG. 5, the blower 42 is coupled to the input port which contains the horizontal oriented burner. The steel casting 20 is cylindrical in shape and has a top opening where the outer chamber of the casting is a closed chamber to accommodate the aqua-ammonia solution, while the inner chamber portion accommodates the burner, which is cylindrical in shape and also is coupled to a blower port so that gas can enter the combustion inner chamber and be ignited by means of a horizontally oriented hot surface igniter. The gas circulating in the fire tube 41 heats the fluid in the outer shell 40, as is known. A drainage port 50 is shown, which port is coupled to the inner chamber and operative to drain fluid from the inner chamber during maintenance. The port 50 can be covered by a suitable cap or other device.

The embodiments described above admirably achieve the objects of the invention. However, it will be appreciated that departures can be made by those skilled in the art without departing from the spirit and scope of the invention which is limited only by the following claims.

I claim:

1. A combustion chamber for igniting a combustible gas to heat a fluid, comprising;

a housing having a burner extending therein in a horizontal orientation in relation to the plane of a bottom surface of the housing, and having an igniter for igniting the combustible gas passing through the burner for heating the fluid, the housing having a top with an opening for exhausting hot gas, the housing including an outer housing and an inner housing arranged therein; and a fluid retaining device being coupled to the inner housing and the outer housing for retaining the fluid to be heated from the hot gas being exhausted from the opening of the housing.

2. A combustion chamber according to claim 1, wherein the outer housing is a steel casting.

3. A combustion chamber according to claim 1, wherein the outer housing has a flange portion in which the burner is coupled.

4. A combustion chamber according to claim 3, wherein the flange portion has a desired wall thickness for allowing a heat-sink effect.

5. A combustion chamber according to claim 1, wherein the igniter has a corresponding horizontal orientation extending in a direction similar to the burner.

6. A combustion chamber according to claim 1, wherein the inner housing has a corresponding top with a corresponding opening for exhausting the hot gas through the fluid retaining device.

7. A combustion chamber according to claim 1, wherein the housing has a cylindrical sidewall with an opening for accommodating the burner.

8. A combustion chamber according to claim 1, wherein the fluid retaining device is arranged between the inner housing and the outer housing in a vertical orientation in relation to the horizontal orientation of the burner.

9. A combustion chamber according to claim 1, wherein the fluid is aqua-ammonia.

10. A combustion chamber for igniting a combustible gas to heat a fluid, comprising;

a housing having a burner extending therein in a horizontal orientation in relation to the plane of a bottom surface of the housing, and having an igniter for igniting the combustible gas passing through the burner for heating the fluid, the housing having a top with an opening for exhausting hot gas, the housing including an inner housing that is a mitered extension that at least partially surrounds the burner; and a fluid retaining device coupled to the housing for retaining the fluid to be heated from the hot gases being exhausted from the opening of the housing.

11. A combustion chamber for igniting a combustible gas to heat a fluid, comprising;

a housing having a burner extending therein in a horizontal orientation in relation to the plane of a bottom surface of the housing, and having an igniter for igniting the combustible gas passing through the burner for heating the fluid, the housing having a top with an opening for exhausting hot gas, the burner having a top perforated portion and a bottom non-perforated portion for coupling to the housing; and a fluid retaining device coupled to the housing for retaining the fluid to be heated from the hot gases being exhausted from the opening of the housing.

12. A combustion chamber for igniting a combustible gas to heat a fluid, comprising:

a housing having a burner extending therein in a horizontal orientation in relation to the plane of a bottom surface of the housing, and having an igniter for igniting the combustible gas passing through the burner for heating the fluid, the housing having a top with an opening for exhausting hot gas; and a fluid retaining device coupled to the housing for retaining the fluid to be heated from the hot gases being exhausted from the opening of the housing, the fluid retaining device having a firetube and an outer shell, the firetube being arranged inside the outer shell for exhausting the hot gases being provided from the opening of the housing.

13. A combustion chamber according to claim 12, wherein the firetube is arranged on the inner housing and the outer shell is arranged on the outer housing for forming a reservoir for holding the fluid.

14. A combustion chamber for igniting a combustible gas to heat a fluid, comprising;

a housing having a burner extending therein in a horizontal orientation in relation to the plane of a bottom surface of the housing, and having an igniter for igniting the combustible gas passing through the burner for heating the fluid, the housing having a top with an opening for exhausting hot gas, the housing having tabs extending on the bottom thereof for retaining the combustion chamber in a vertical orientation; and a fluid retaining device coupled to the housing for retaining the fluid to be heated from the hot gases being exhausted from the opening of the housing.

15. A combustion chamber for igniting a combustible gas to heat a fluid, comprising;

a housing having a burner extending therein in a horizontal orientation in relation to the plane of a bottom surface of the housing, and having an igniter for igniting the combustible gas passing through the burner for heating the fluid, the housing having a top with an opening for exhausting hot gas;

a fluid retaining device coupled to the housing for retaining the fluid to be heated from the hot gases being exhausted from the housing; and a blower for providing the combustible gas to the burner.

16. A combustion chamber for igniting a combustible gas to heat a fluid, comprising:

a housing having a burner extending therein in a horizontal orientation in relation to the plane of a bottom surface of the housing, and having an igniter for igniting the combustible gas passing through the burner for heating the fluid; and a fluid retaining device coupled to the housing for retaining the fluid to be heated from the housing and having a firetube arranged inside an outer shell.

17. A combustion chamber according to claim 16, wherein the housing includes an outer housing and an inner housing arranged therein.

18. A combustion chamber according to claim 17, wherein the fluid retaining device is arranged between the inner housing and the outer housing in a vertical orientation in relation to the horizontal orientation of the burner.

19. A combustion chamber according to claim 16, wherein the housing includes an outer housing that is a steel casting.

20. A combustion chamber according to claim 16, wherein the housing includes an outer housing that has a flange portion in which the burner is coupled.

21. A combustion chamber according to claim 20, wherein the flange portion has a desired wall thickness for allowing a heat-sink effect.

22. A combustion chamber according to claim 16, wherein the housing includes an inner housing that is a mitered extension that at least partially surrounds the burner.

23. A combustion chamber according to claim 16, wherein the burner has a top perforated portion and a bottom non-perforated portion for coupling to the housing.

24. A combustion chamber according to claim 16, wherein the igniter has a corresponding horizontal orientation extending in a direction similar to the burner.

25. A combustion chamber according to claim 16, wherein the housing has a top with an opening for exhausting hot gas through the firetube.

26. A combustion chamber according to claim 25, wherein the housing includes an inner housing that has a corresponding top with a corresponding opening for exhausting the hot gas through the firetube.

27. A combustion chamber according to claim 16, wherein the housing has a cylindrical sidewall with an opening for accommodating the burner.

28. A combustion chamber according to claim 16, wherein the firetube is arranged on the inner housing and the outer shell is arranged on the outer housing for forming a reservoir for holding the fluid.

29. A combustion chamber according to claim 16, wherein the fluid is aqua-ammonia.

30. A combustion chamber according to claim 16, wherein the housing has tabs extending on the bottom thereof for retaining the combustion chamber in a vertical orientation.

31. A combustion chamber according to claim 16, wherein the combustion chamber comprises a blower for providing the combustible gas to the burner.

32. A combustion chamber for igniting a combustible gas to heat a fluid, comprising:

a housing having a burner extending therein in a horizontal orientation in relation to the plane of a bottom surface of the housing, and having an igniter for igniting the combustible gas passing through the burner for heating the fluid, the housing having tabs extending on the bottom thereof for retaining the combustion chamber in a vertical orientation; and a fluid retaining device coupled to the housing for retaining the fluid to be heated from the housing.

33. A combustion chamber according to claim 32, wherein the housing has a top with an opening for exhausting hot gas through the fluid retaining device.

34. A combustion chamber according to claim 33, wherein the housing includes an inner housing that has a corresponding top with a corresponding opening for exhausting the hot gas through the fluid retaining device.

35. A combustion chamber according to claim 32, wherein the housing includes an outer housing and an inner housing arranged therein; and wherein the fluid retaining device is arranged between the inner housing and the outer housing in a vertical orientation in relation to the horizontal orientation of the burner.

36. A combustion chamber according to claim 32, wherein the fluid retaining device comprises a firetube arranged inside an outer shell.

37. A combustion chamber according to claim 36, wherein the firetube is arranged on the inner housing and the outer shell is arranged on the outer housing for forming a reservoir for holding the fluid.

38. A combustion chamber for igniting a combustible gas to heat a fluid, comprising:

a housing having a burner extending therein in a horizontal orientation in relation to the plane of a bottom surface of the housing, and having an igniter for igniting the combustible gas passing through the burner for heating the fluid, the housing including an outer housing and an inner housing arranged therein; and a fluid retaining device coupled to the housing for retaining the fluid to be heated from the housing, the fluid retaining device being arranged between the inner housing and the outer housing in a vertical orientation in relation to the horizontal orientation of the burner.

39. A combustion chamber according to claim 38, wherein the housing has a top with an opening for exhausting hot gas through the fluid retaining device.

40. A combustion chamber according to claim 39, wherein the housing includes an inner housing that has a corresponding top with a corresponding opening for exhausting the hot gas through the fluid retaining device.

41. A combustion chamber according to claim 38, wherein the fluid retaining device comprises a firetube arranged inside an outer shell.

42. A combustion chamber according to claim 41, wherein the firetube is arranged on the inner housing and the outer shell is arranged on the outer housing for forming a reservoir for holding the fluid.

43. A combustion chamber according to claim 38, wherein the housing has tabs extending on the bottom thereof for retaining the combustion chamber in a vertical orientation.

* * * * *